US005709822A

United States Patent [19]

Togashi

[11] Patent Number: 5,709,822

[45] Date of Patent: Jan. 20, 1998

[54] FUEL REGULATING MECHANISM FOR A ROTARY THROTTLE VALVE TYPE CARBURETOR

[75] Inventor: Michiyasu Togashi, Tokyo, Japan

[73] Assignee: Walbro Corporation, Cass City, Mich.

[21] Appl. No.: 682,124

[22] Filed: Jul. 17, 1996

[51] Int. Cl.[6] ..... F02M 9/08

[52] U.S. Cl. ..... 261/44.2; 261/44.8; 261/DIG. 84

[58] Field of Search ..... 261/44.2, 44.8, 261/DIG. 84

[56] References Cited

U.S. PATENT DOCUMENTS

| | | | |
|---|---|---|---|
| 1,737,496 | 11/1929 | Feroldi | 261/44.8 |
| 1,782,848 | 11/1930 | Gravely | 261/44.8 |
| 3,454,264 | 7/1969 | Sarto | 261/DIG. 84 |
| 5,599,484 | 2/1997 | Tobinai | 261/44.8 |

FOREIGN PATENT DOCUMENTS

| | | | |
|---|---|---|---|
| 21510 | 10/1920 | France | 261/44.2 |
| 625006 | 8/1927 | France | 261/44.2 |
| 633825 | 2/1928 | France | 261/44.2 |
| 493733 | 3/1930 | Germany | 261/44.8 |
| 1332 | 1/1977 | Japan . | |
| 110847 | 1/1983 | Japan | 261/44.8 |
| 110847 | 7/1983 | Japan | 261/44.8 |
| 8009 | 1/1993 | Japan . | |
| 6-60753 | 8/1994 | Japan . | |

*Primary Examiner*—Tim R. Miles

*Attorney, Agent, or Firm*—Barnes, Kisselle, Raisch, Choate, Whittemore & Hulbert

[57] ABSTRACT

A fuel regulating method and mechanism for a rotary throttle (barrel-type) carburetor which prevents an end-user A/F adjustment that would cause increase in fuel quantity to a level in excess of a regulated value so as to comply with the exhaust gas emissions regulations. A cylindrical throttle valve having a throttle hole is disposed in an air intake passage of the carburetor body 12, the air flow is controlled by rotation of the throttle valve and the fuel flow is controlled by the position of a fuel regulating needle, attached to the throttle valve, relative to a fuel jet port of a fuel supply pipe in the carburetor body due to axial movement of the throttle valve. A bypass passage is provided within the carburetor body to communicate the throttle valve hole and fuel jet area with the air intake passage upstream of the throttle valve. An air flow regulating needle valve in the air passage is operable to adjust the bypass air flow in the air passage to lean the pre-set idle A/F ratio from a maximum rich factory adjustment. The fuel regulating needle valve is sealed to prevent exterior access by the end-user after making the factory adjustment.

7 Claims, 4 Drawing Sheets

[Fig. 1]
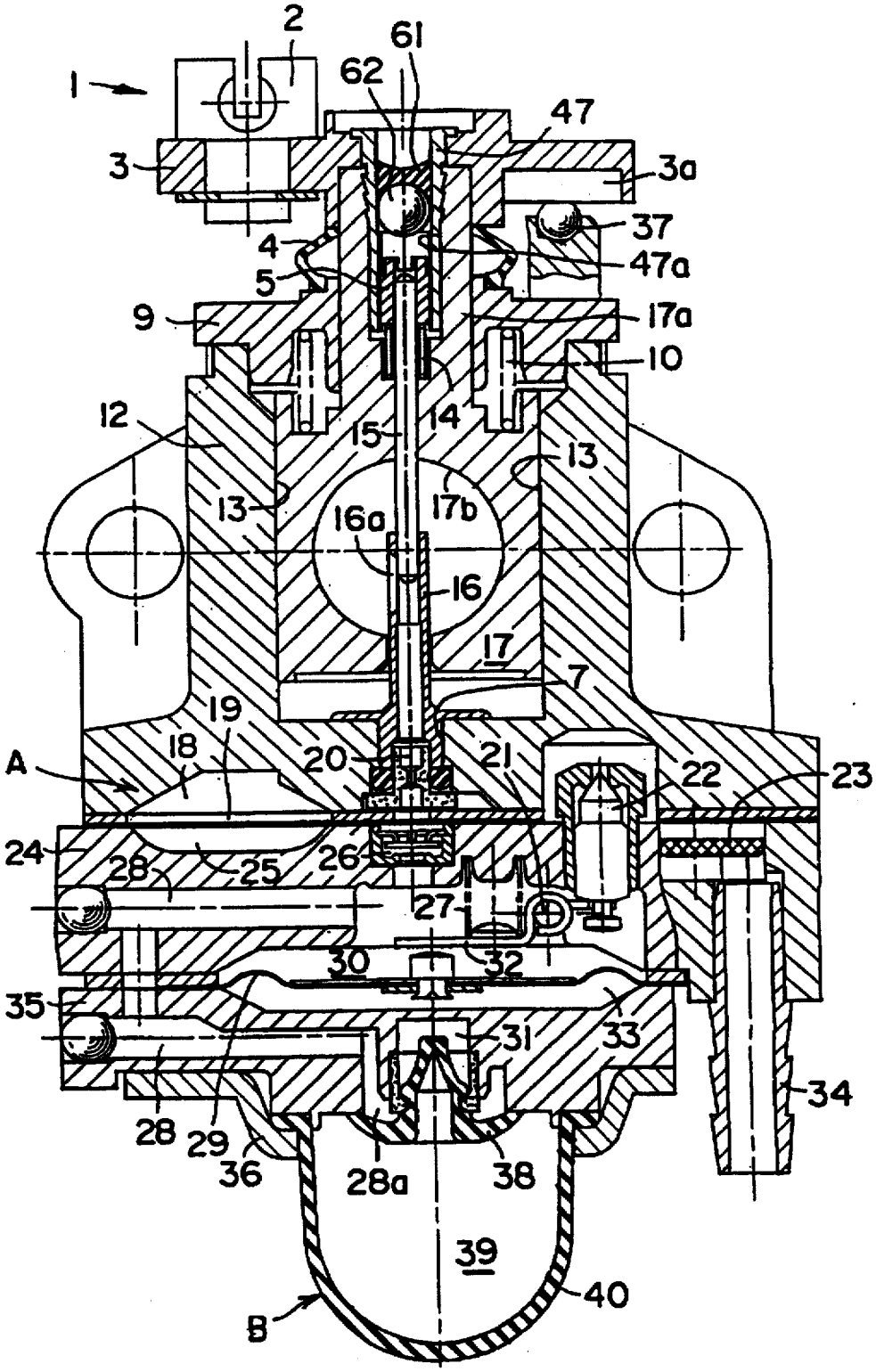

[Fig. 2]
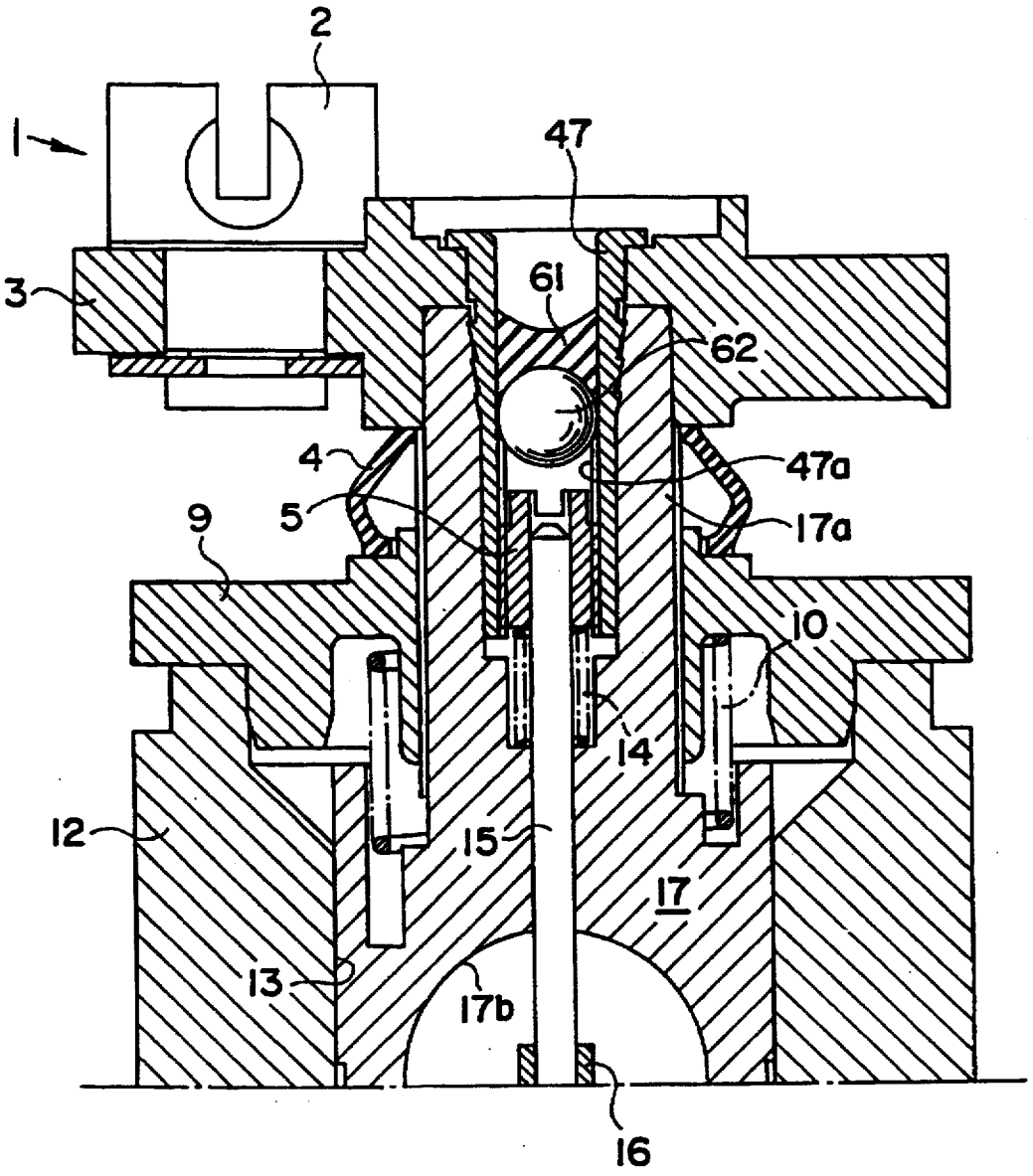

[Fig. 3]
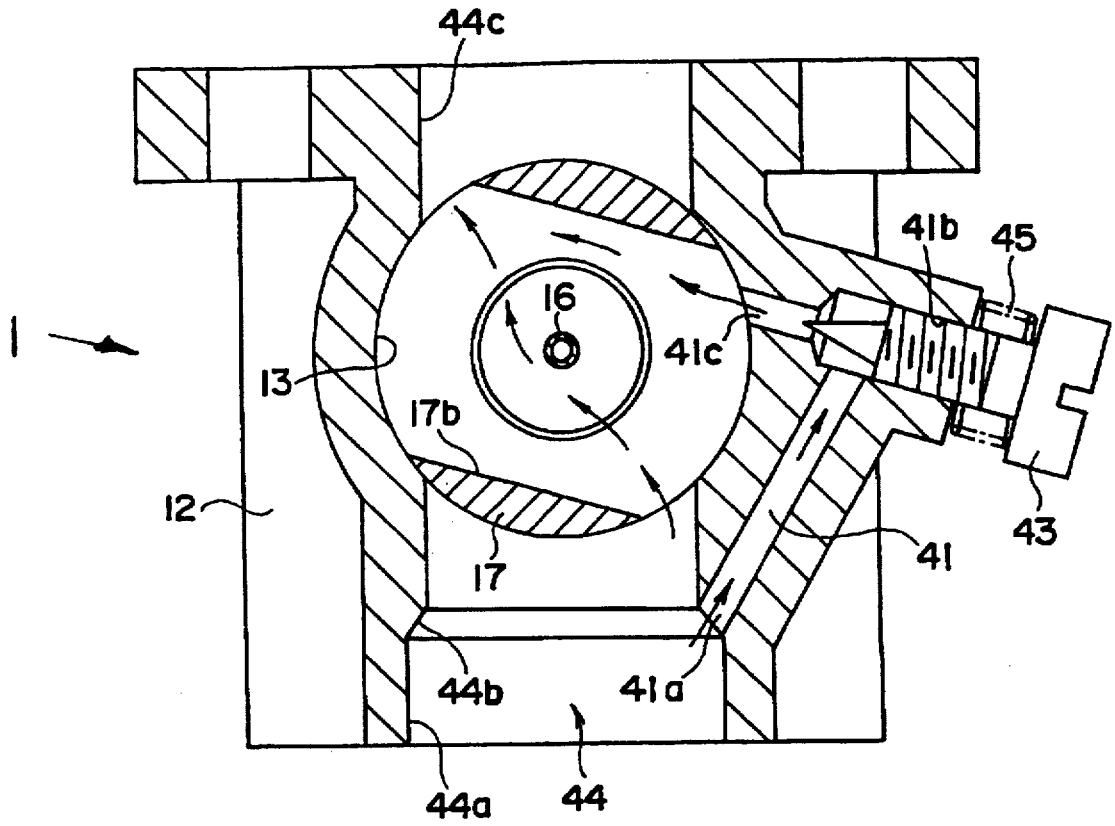
[Fig. 4]
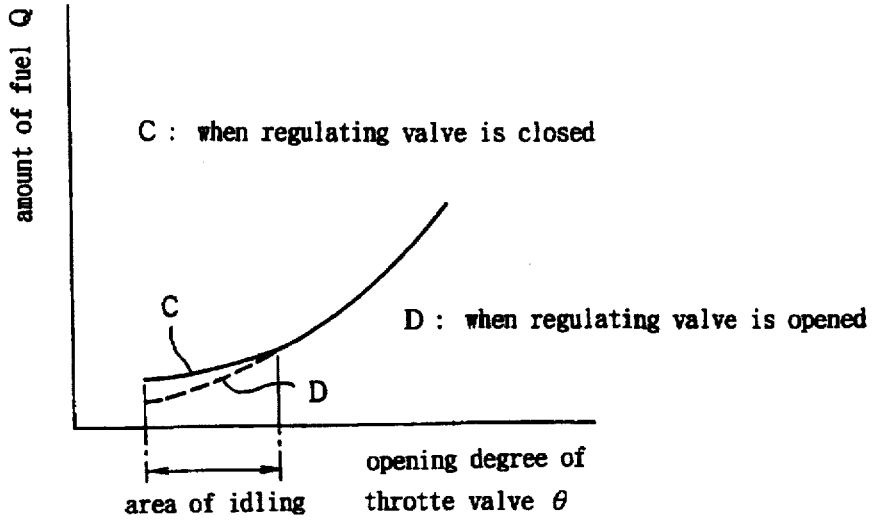

[Fig. 5]
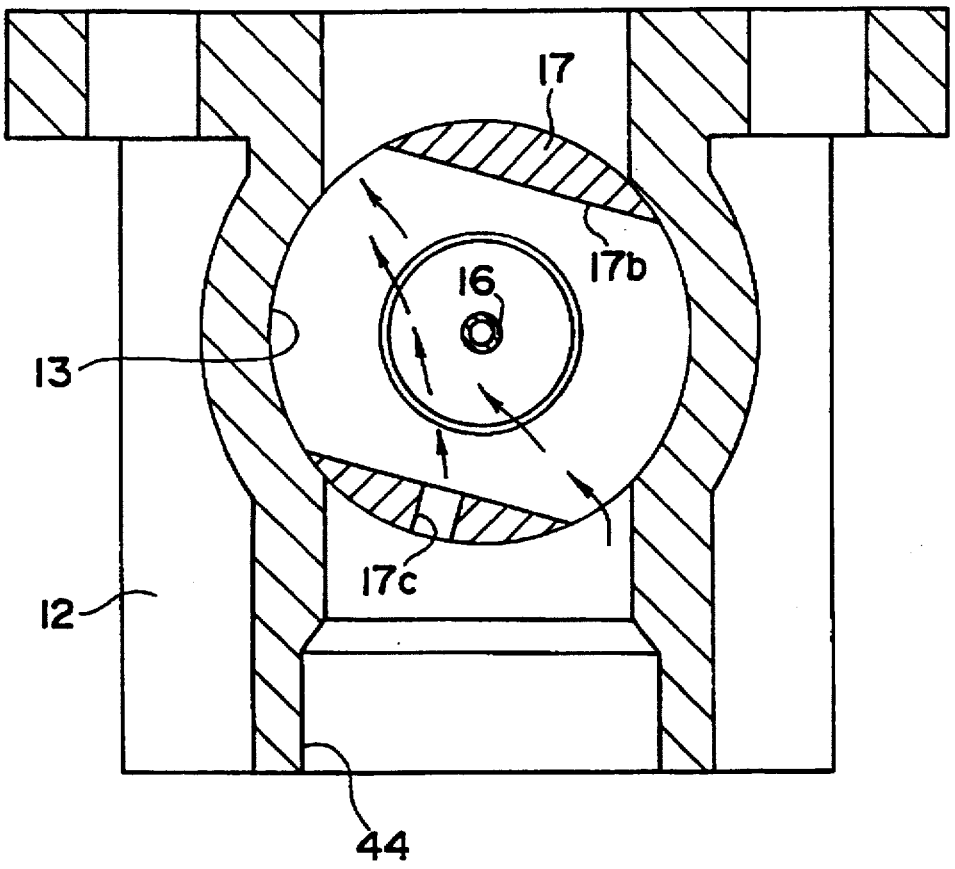
PRIOR ART

FUEL REGULATING MECHANISM FOR A ROTARY THROTTLE VALVE TYPE CARBURETOR

FIELD OF THE INVENTION

The present invention relates to a rotary throttle type carburetor suitable for a small type 2-stroke internal combustion engine used as a driving source of a portable implement such as a power saw, a brush cutter or the like, and particularly to a fuel regulating mechanism for a rotary throttle type carburetor which observes exhaust gas regulations in a low speed operating area of the engine.

BACKGROUND OF THE INVENTION

There are various known methods for regulating the low speed fuel delivery of a carburetor. For example, as disclosed in Japanese Utility Model Application No. 8009/1993, an open area of a fuel jet port is changed by a relative position between a fuel supply pipe secured to a carburetor body and a needle supported on a diametrically central part of a throttle valve, and as disclosed in Japanese Patent Laid-Open Publication No. 1332/1977, fuel is regulated by a pilot screw downstream of a throttle valve. The former fuel regulating mechanism has a problem in that since a regulating member is provided at a corner portion of a throttle valve, the regulation is difficult. The latter fuel regulating mechanism has a problem in that, since an area is provided in which the low speed fuel flow is switched to a high speed fuel flow, accelerating performance and fuel atomizing characteristics are poor. Further, since the full length of the carburetor body is long, the mechanism is not suitable for as small engine mounted on a compact portable operating implement such as a power saw and a lawn mower.

Recently, with the application of governmental exhaust gas regulations extended to a portable operating implement having a small type 2-stroke engine mounted thereon, there has been proposed a construction in which a fuel limiting cap for regulating a low speed fuel quantity is mounted on a carburetor so that an operator cannot increase the low speed fuel quantity to a level in excess of the regulated value. However, since the fuel limiting cap is arranged on a narrow portion of a proximal end of a throttle valve shaft, it is difficult to provide a construction having a strength which cannot be broken either intentionally or unintentionally by an operator.

A valve type carburetor disclosed in Japanese Patent Laid-Open No. 110847/1983 is known in which, as shown in FIG. 5, in order to change a flow of air with respect to a fuel pipe 16 which projects toward a throttle hole **17*b* of a rotary throttle valve 17, that is, in order to change a suction negative pressure exerting on a fuel jet port 16*a* at an idle position of the throttle valve 17, a through-hole 17*c* opening to an inlet of an air intake passage 44 is provided in a wall portion of the throttle hole 17*b* of the throttle valve 17. In this proposal, the inside diameter of the through-hole 17*c*** is selected according to the specification of the engine. Therefore, the fuel quantity at the idle position is fixed to a predetermined value and cannot be freely adjusted.

OBJECTS OF THE INVENTION

In the light of the foregoing, an object of the present invention is to provide, in a carburetor in which a fuel supply pipe and a fuel needle are provided at a diametrically central part of a rotary throttle valve, a fuel regulating mechanism for a rotary throttle type carburetor which prevents an increase in fuel quantity to a level in excess of a regulated value to thereby comply with present and proposed governmental exhaust gas regulations.

SUMMARY OF THE INVENTION

In general, and by way of summary description and not by way of limitation, the present invention accomplishes the foregoing object by providing a fuel regulating mechanism for a rotary throttle type carburetor in which a cylindrical throttle valve having a throttle hole is disposed in an air intake passage of a carburetor body, a quantity of air is controlled by rotation of the throttle valve, and a quantity of fuel is controlled by a relative position of a needle attached to the throttle valve to a fuel jet port of a fuel supply pipe secured to the carburetor body due to an axial movement of the throttle valve, and which is provided with an air passage for communicating the throttle hole of the throttle valve with an upstream side portion of the throttle valve of an air intake passage of the carburetor body.

In the present invention, an air quantity regulating needle valve for adjusting the air quantity is provided in an air passage for communicating a throttle hole of a rotary throttle valve with an upstream side portion of the throttle valve in an air intake passage of a carburetor body so that a concentration of an air/fuel (A/F) mixture does not exceed the value of the exhaust gas regulations because air quantity and not fuel quantity is regulated by this needle valve.

When in assembly at a factory, the air quantity regulating needle valve is placed in a completely closed state, and the conventional fuel regulating needle mounted on the diametrically central part of the throttle valve is regulated in advance to the maximum fuel quantity which is allowed in terms of the exhaust gas regulations. Then, an anti-tamper closing member is forced into the needle mounting hole at the diametrically central part of the throttle valve so that the fuel regulating needle cannot be regulated from outside.

When the operator regulates the fuel quantity in the engine idle operating range, the quantity of air flowing through the air passage for communicating the upstream side portion of the throttle valve of the air intake passage with the throttle hole of the throttle valve is regulated by adjusting the air quantity regulating needle valve. If the quantity of air flow through the air passage is thus increased, the A/F mixture becomes lean, and if the air quantity is decreased, the mixture becomes rich. However, since the concentration of the A/F mixture is preset, it will not exceed the value of the exhaust gas regulations. That is, even if the air quantity regulating needle valve is fully opened, and even if the air quantity regulating needle valve is removed, the air quantity merely becomes maximum and the concentration of the mixture does not become rich because the maximum rate of fuel delivery is independently controlled and has already been preset by the aforementioned factory pre-adjustment of the fuel regulating needle.

BRIEF DESCRIPTION OF THE DRAWINGS

The foregoing as well as other objects, advantages and features of the present invention will become apparent from the following detailed description, appended claims and accompanying drawings in which:

FIG. 1 is a front sectional view of the fuel regulating mechanism for a rotary throttle valve type carburetor according to the present invention;

FIG. 2 is a fragmentary front sectional view showing on art enlarged scale essential parts of the rotary throttle type carburetor of FIG. 1;

FIG. 3 is a plan sectional view showing on an enlarged scale the fuel regulating mechanism;

FIG. 4 is a diagram showing the operational characteristics of the fuel regulating mechanism; and FIG. 5 is a plan sectional view showing on an enlarged scale essential parts of a conventional prior art rotary throttle type carburetor described previously hereinabove.

DETAILED DESCRIPTION OF PREFERRED EMBODIMENT

As shown in FIG. 1, a rotary throttle valve type carburetor 1 embodying the invention has a carburetor body 12 with an air intake passage 44 (a passage at a right angle to the paper surface; see FIG. 3) and contains a vertical cylindrical portion 13, oriented with its axis perpendicular to that of passage 44, and closed at its lower end. A throttle valve 17 rotatably and axially movably fitted in the cylindrical portion 13 is provided with a cylindrical throttle hole 17*b* which can be matched to the air intake passage. The throttle valve 17 is biased downward into engagement with a cam mechanism described later by of spring 10 received between a lid plate 9 for closing the upper end of the cylindrical portion 13 and the throttle valve 17. A valve shaft 17*a* projecting upward from the throttle valve 17 is connected with a valve lever 3 passaging through the lid plate 9. A dust boot 4 for covering the valve shaft 17*a* is interposed between the valve lever 3 and the lid plate 9. A swivel 2 supported on the valve lever 3 is connected to a manual accelerating lever for controlling carburetor operation by an operator through a remote cable.

The aforementioned cam mechanism is composed of a cam face 3*a* formed on the lower surface of the valve lever 3 and a follower 37 projecting upward from the lid plate 9. The throttle valve 17 is moved upward by the cam mechanism against the force of the spring 10 proportional to the amount of rotation of the valve lever 3. At this time, a matching area (an opening degree of the throttle valve 17) between the throttle hole 17*b* and the air intake passage to the carburetor body 12 increases, and the needle 15 mounted on the throttle valve 17 moves upward so that an opening degree of a nozzle or a fuel jet port 16*a* of the fuel supply pipe 16 increases and the fuel quantity corresponding to the opening degree of the throttle valve 17 is sucked into the throttle hole 17*b* of the throttle valve 17 from the fuel jet port 16*a*.

The fuel supply pipe 16 has a proximal end fitted in the bottom wall of the carburetor body 12, more specifically, in the mounting hole 7 provided in the bottom wall of the cylindrical portion 13 and is communicated with a constant pressure fuel chamber 30 for holding fuel at a predetermined pressure via a jet 20 and a check valve 26 provided on the bottom wall of the cylindrical portion 13. The extreme end of the fuel supply pipe 16 projects into the throttle hole 17*b* of the throttle valve 17.

Fuel in a fuel tank is supplied to the constant pressure fuel chamber 30 via a main fuel pump A by driven by a diaphragm 19 which receives the pulsating pressure in a crank chamber of a 2-stroke engine. The diaphragm 19 is held between the carburetor body 12 and a bottom plate 24 to define a pulsating pressure introducing chamber 18 and a pump chamber 25. As the diaphragm is displaced up and down, the fuel in the fuel tank is sucked into the pump chamber 25 via an inlet pipe 34, a filter 23 and a passage provided with a check valve (not shown) and thence supplied to the constant pressure fuel chamber 30 via a passage provided with a check valve (not shown) and inlet valve 22.

The constant pressure fuel chamber 30 is defined above a diaphragm 29 held between the bottom plate 24 and a cover 35, and an atmospheric chamber 33 is defined below the diaphragm 29. A lever 32 supported by a support shaft 21 on the wall potion of the constant pressure fuel chamber 30 of the bottom plate 24 has one end connected at the inlet valve 22 and the other end engaged with a projection in the center of the diaphragm 29 by the force of a spring 27. When the fuel in the constant pressure fuel chamber 30 is reduced, the diaphragm 29 and the lever 32 are forced up by the pressure of the atmospheric chamber 33 against the force of the spring 27 so that the lever 32 rotates clockwise around the support shaft 21, the inlet valve 22 opens and the fuel in the pump chamber 25 is replenished into the constant pressure fuel chamber 30 via the inlet valve 22. When the fuel in the constant pressure fuel chamber 30 increases, the diaphragm 29 is forced down so that the lever 32 rotates counterclockwise around the support shaft 21 and the inlet valve 22 closes.

In the case where fuel is not present in the constant pressure fuel chamber 30 before starting the engine, manual priming of chamber 30 with fuel occurs when a syringe 40 constituting a manual auxiliary fuel pump B is repeatedly manually squeezed or depressed. This causes air in the constant pressure fuel chamber 30 to force open a peripheral edge of a mushroom-like composite check valve 38 from an inlet 38*a* via a passage 28, and such air is sucked into the pump chamber 39, and further forces open a flat end of a cylindrical portion of the composite check valve 38 to flow out into an outlet chamber 31 and is discharged outside from an outlet, not shown. When the constant pressure fuel chamber 30 assumes a negative pressure, the fuel in the fuel tank is sucked into the pump chamber 25 via an inlet pipe 34, a filter 23 and a passage provided with a check valve, not shown, and further is supplied to the constant pressure fuel chamber 30 via a passage provided with a check valve, not shown, and the inlet 22.

The syringe 40 has a peripheral edge connected to the lower surface of the cover 35 by an annular retaining plate 36 and a composite check valve 38 is fastened at a cylindrical outlet chamber 31 provided in the center of the cover 35. The composite check valve 38 closes between the inlet 28*a* communicating to the constant pressure fuel chamber 30 and the pump chamber 39 at the peripheral edge of an umbrella portion and closes between the pump chamber 39 and the outlet chamber 31 at the flat end of the cylindrical portion.

A barbed tubular member 47 is fitted in and barb-secured to a cylindrical portion 47*a* provided in the center of the upper end of the valve shaft 17*a* of the throttle valve 17 so that member 47 cannot slip out. A head 5 coupled to the needle 15 is screwed into the tubular member 47. The spring 14 is interposed between the head 5 and the bottom wall of the cylindrical portion 47*a* of the valve shaft 17*a*. That is, the head 5 of the needle 15 is threadedly moved relative to the cylindrical portion 47*a* of the valve shaft 17*a* to set an opening degree of the fuel jet port 16*a* at the idle position of the throttle valve 17 so as not to exceed the value of the exhaust gas regulations. Then exterior access to head 5 is sealed off by a ball 62 serving as a closing member, that is pressed into the tubular member 47, and then adhesive 61 is filled therein above ball 62.

As shown in FIG. 3, according to the present invention, the quantity of fuel during the idle operation is adjusted by the suction negative pressure in the periphery of the fuel supply pipe 16 according to the peripheral environment and the operating conditions of the engine. To this end, an inlet end 41*a* of an air passage 41 formed at the wall between an inlet bore 44*a* and outlet bore 44*c* of passage 44, bore 44*c* being of reduced diameter relative to passage inlet 44*a* such that there is a change in sectional area between an inlet 44*a* and an outlet 44*c* of an air intake passage 44 of the carburetor body 12 to thereby provide a venturi effect in passage 44. An outlet end 41*c* of the air passage 41 opens to the cylindrical portion 13 into which the throttle valve 17 is inserted. The direction (axis) of the outlet end 41*c* is substantially parallel with the direction (axis) of the throttle hole 17*b* of the throttle valve 17 at the idle position thereof.

A tapped hole 41*b*, coaxial with the outlet end 41*c*, is provided at the halfway portion of the air passage 41 on the wall portion of the carburetor body 12, and an air quantity regulating needle valve 43 is threaded in the tapped hole 41*b*. A spring 45 for suppressing play and looseness of the air quantity regulating needle valve 43 is disposed between the head of the air quantity regulating needle valve 43 and the carburetor body 12.

Next, the set-up and operation of the fuel regulating mechanism for a rotary throttle valve type carburetor according to the present invention will be described. In assembly at the factory, the air quantity regulating needle valve 43 is screwed into the tapped hole 41*b* to close the air passage 41. Then the relative position of the needle 15 with respect to the fuel jet port 16*a* at the idle position of the throttle valve 17, that is, the opening degree of the fuel jet port 16*a* is set. Next, the closing member 62 is fitted in the tubular member 47 of the valve shaft 17*a* and fixed by the adhesive 61. In this manner, the opening degree of the fuel jet port 16*a* at the idle position of the throttle valve 17 is factory preset so as not to exceed the value of the exhaust gas regulations.

In the state where the air quantity regulating needle valve 43 is closed, the total quantity of air flowing into the air intake passage 44 of the carburetor under the idling operation of the engine flows to the outlet 44*c* of the air intake passage 44 solely via that portion of the throttle hole 17*b* of the throttle valve 17 exposed to and directly open to passage 44 upstream of valve 17. At this time, the suction negative pressure exerted on the fuel jet port 16*a* of the fuel supply pipe 16 is highest, and the quantity of fuel flowing out of the fuel jet pot 16*a* is maximum accordingly to supply the richest mixture to the engine. A fuel quantity Q at the idle operating area changes corresponding to an opening degree of the throttle valve 17 as indicated by the line C in the graph of FIG. 4.

On the other hand, when the fuel quantity is adjusted according to the operating environment and end-use conditions of the engine by the engine-driven appliance operator, the air quantity regulating needle valve 43 is opened. According to the opening degree of the air quantity regulating needle valve 43, the quantity of air bypassing the inlet portion of throttle hole passage 17*b* open to passage 44 via the air passage 41 from the air intake passage 44, correspondingly increases. Consequently, the suction negative pressure being exerted on the fuel jet port 16*a* of the fuel supply pipe 16 approaches atmospheric pressure, and therefore the fuel quantity sucked into the throttle hole 17*b* from the fuel jet port 16*a* decreases. The fuel quantity Q when the air quantity regulating needle valve 43 is fully opened is thus decreased from that when the air quantity regulating needle valve 43 is closed, as indicated by the broken line D in FIG. 4.

As described above, according to the present invention, there is provided a regulatable bypass air passage 41 for communicating a throttle hole 17*b* of a throttle valve with an upstream portion 44*a* an air intake passage 44 of a carburetor body. In assembly of the carburetor on an engine at a factory, a fuel quantity corresponding to the low speed operation of the engine, with the throttle valve 17 so set and with the regulatable bypass air passage 41 closed is fixed by adjustment of needle valve 15 and fixed so as not to exceed the exhaust gas regulations. In end use air quantity flowing through the bypass air passage 41 is adjusted by the air quantity regulating valve 43 to regulate the concentration of the A/F carburetor output mixture supplied to the engine at idle (low speed). With this arrangement, regardless of how the air quantity regulating valve 43 is operated or even if the air quantity regulating valve is removed, it is not possible to degrade the pre-set idle operation such that the concentration of A/F mixture supplied to the engine exceeds the value of the exhaust gas regulations.

With respect to the needle 15 for directly regulating the fuel quantity, the fuel quantity is pre-set during factory adjustment of the idle operation, then the head 5 of needle 15 is blocked by the closing member 62 and this in mm covered and fixed by the adhesive 61 so that the fuel quantity cannot be regulated after being set when it is assembled at the factory. Therefore, the operator cannot regulate the needle from outside the carburetor.

From the foregoing description and drawings, it will also be well understood by those skilled in the art that outlet 41*c* of the bypass air passage 41 is located relative to the inlet opening of throttle hole 17*b* such that clockwise rotation of valve 17 from its idle position shown in FIG. 3 toward wide open will cause the sidewall of throttle 17 to close outlet 41*c*. Hence, the A/F output of carburetor 1 in the engine operational speed and load range above idle is not affected by the presence of bypass passageway 41, much less by the presence, absence and/or setting of idle bypass regulating needle valve 43.

Moreover, it will also be well understood from the foregoing that, if desired, fuel regulating needle 15 can be factory set at some predetermine A/F setting slightly below maximum permissible rich, while air bypass quantity regulating valve 43 is likewise pre-set at a predetermined setting between fully closed and fully open relative to passage 41. Then when operating under such engine idle operation setting of valve 17 screw 43 can be mined in from its pre-set factory position so as to increase negative pressure being exerted on fuel jet port 16*a* and thus increase the fuel flow rate and thereby enrich A/F, provided that when needle valve 43 is fully closed to shut off air flow in bypass passage 41 the resultant A/F enrichment does not thereby exceed the maximum A/F rich limit desired for engine idle operation in order to meet engine exhaust emission regulations.

What is claimed is:

1. In a fuel regulating mechanism for a carburetor in which a throttle valve having a throttle hole is disposed in an air intake passage of a carburetor body, and wherein the quantity of air flow in the air intake passage is controlled by movement of the throttle valve to thereby vary the opening area of the throttle hole exposed to the intake passage upstream of the throttle valve, and a quantity of fuel is controlled by a relative position of a fuel regulating needle attached to the throttle valve to a fuel jet port of a fuel supply pipe secured to the carburetor body due to movement of the throttle valve, and wherein the throttle valve is cylindrical and rotatable about an axis transverse to the axes of the throttle hole and carburetor air intake passage for controlling air flow through the carburetor air intake passage and wherein the throttle valve is movable along an axis transverse to the axes of the throttle hole and carburetor air intake passage for controlling air flow through the carburetor air intake passage, the improvement in combination therewith of a bypass air passage for variably communicating the throttle hole of the throttle valve at an upstream portion thereof with the air intake passage of the carburetor body in bypass relation to the opening area of the throttle hole exposed to the air intake passage at engine idle setting of the throttle valve, wherein an air quantity regulating needle valve is provided in said bypass air passage to variably adjust the quantity of air flowing in the bypass air passage to the throttle hole, wherein a closing member is non-removably fitted in said carburetor to permanently prevent exterior access to an adjustment portion of the fuel regulating needle located at one end thereof, and the end of the needle opposite said one end is inserted into said fuel supply pipe so that the adjustment of needle regulation of said fuel jet port cannot be made from outside of said carburetor after a low speed fuel quantity has been set prior to fitment of said closing member and wherein said bypass air passage has an outlet constructed and arranged relative to said throttle valve so as to be closed by movement of said throttle valve out of idle setting toward high speed and/or maximum power setting and thereby de-register the throttle hole with said bypass air passage outlet.

2. The fuel regulating mechanism according to claim 1, wherein said closing member is coated with an adhesive.

3. The fuel regulating mechanism according to claim 1 wherein said closing member is a ball.

4. The fuel regulating mechanism according to claim 1, wherein said bypass air passage comprises a straight first passage portion and a straight second passage portion oriented such that their respective axes intersect one another at an acute angle, the downstream end of said second portion defining said bypass passage outlet, the upstream end of said first portion defining an inlet of said bypass air passage communicating with the air intake passage of the carburetor body upstream of said throttle valve, said air quantity regulating needle valve being threadably mounted in said carburetor body in a threaded opening forming an extension of said second portion of said air intake passage, said needle valve having an adjustment head exposed exteriorly of said carburetor body.

5. The fuel regulating mechanism according to claim 4 wherein the second portion of the air bypass passage is oriented with its axis generally parallel with the axis of said throttle hole of said throttle valve when the throttle valve is oriented at the idle position thereof, and such that an imaginary extension of the axis of said air bypass passage second portion in such idle position of said throttle valve is located generally adjacent the downstream side of the throttle valve hole.

6. The fuel regulating mechanism according to claim 5 wherein said carburetor body air intake passage is defined by an inlet bore coaxial with an outlet bore, said outlet bore being of reduced diameter relative to said inlet bore such that there is a change in sectional area between the inlet and outlet of the carburetor body air intake passage to thereby provide a venturi effect in such air intake passage, and wherein said inlet of said bypass air passage first portion is formed in the wall of said carburetor body air passage generally at the junction of said inlet and outlet bores of said carburetor body air passage.

7. The fuel regulating mechanism according to claim 6 wherein an imaginary extension of said first portion of said bypass air passage from the inlet thereof into said carburetor body air intake passage extends through the inlet thereof to the exterior of said carburetor body to facilitate drilling of said first portion of said bypass air passage by access through the inlet of said carburetor body in the manufacture thereof.

* * * * *